US010099501B2

(12) United States Patent
Mueller

(10) Patent No.: US 10,099,501 B2
(45) Date of Patent: Oct. 16, 2018

(54) METHOD FOR THE PREFORMING AND ROUNDING OF A BOOK BLOCK

(71) Applicant: MUELLER MARTINI HOLDING AG, Hergiswil (CH)

(72) Inventor: Hans Mueller, Lauda Koenigshofen (DE)

(73) Assignee: MUELLER MARTINI HOLDING AG, Hergiswil (CH)

( * ) Notice: Subject to any disclaimer, the term of this patent is extended or adjusted under 35 U.S.C. 154(b) by 0 days.

(21) Appl. No.: 15/411,990

(22) Filed: Jan. 21, 2017

(65) Prior Publication Data

US 2017/0217240 A1 Aug. 3, 2017

(30) Foreign Application Priority Data

Feb. 1, 2016 (CH) ..... 0133/16

(51) Int. Cl.
*B42C 5/02* (2006.01)

(52) U.S. Cl.
CPC ..... *B42C 5/02* (2013.01)

(58) Field of Classification Search
CPC ..... B42C 5/02; B42C 7/004
See application file for complete search history.

(56) References Cited

U.S. PATENT DOCUMENTS 2,098,060 A * 11/1937 Moyer ..... B42C 7/004 412/17
3,413,669 A * 12/1968 Thorp ..... B42C 5/02 412/13
4,289,493 A * 9/1981 Hedrich ..... B42C 7/006 156/480
5,104,275 A * 4/1992 Rathert ..... B42C 5/02 412/1

(Continued)

FOREIGN PATENT DOCUMENTS

DE 10 2004 026627 A1 12/2005
EP 1350634 A2 10/2003
JP 2014-184618 A 10/2014

OTHER PUBLICATIONS

International Search Report for 00133/16, dated Mar. 11, 2016, and English translation thereof.

*Primary Examiner* — Charles A Fox
*Assistant Examiner* — Christopher E Veraa
(74) *Attorney, Agent, or Firm* — FisherBroyles, LLP; Robert Kinberg

(57) ABSTRACT

An apparatus and a method for the preforming and rounding of a book block. A support strip is arranged at an adjustable loading height for accommodating a fore-edge of the book block to be rounded. A transport device transports the book block at the loading height toward the support strip. A preform press is adjustable in a vertical direction above the back of the book block and includes at least two preforming tools. A rounding device including two rounding rolls driven (Continued)

in opposite directions for rotation around parallel rotational axes clamps the book block between the two rounding rolls for rounding the book block. At least a first drive is connected to at least one of the preforming tools to displace at least one of the preforming tools in a longitudinal direction extending parallel to the rotational axes to change a spacing between the preforming tools in the longitudinal direction.

18 Claims, 5 Drawing Sheets

(56) References Cited

U.S. PATENT DOCUMENTS 5,658,111 A * 8/1997 Rathert ..... B42C 5/02 412/30
6,158,940 A * 12/2000 Nehring ..... B42C 5/02 412/18
6,171,045 B1 * 1/2001 Nehring ..... B42C 13/00 412/30
2003/0215308 A1 11/2003 Rathert
2004/0131447 A1 * 7/2004 Albrecht ..... B42C 5/02 412/14
2006/0140742 A1 * 6/2006 Brommer ..... B42C 5/02 412/22
2008/0138172 A1 * 6/2008 Brommer ..... B42C 13/003 412/22
2011/0014011 A1 * 1/2011 Schilling ..... B42C 7/004 412/3
2011/0123298 A1 * 5/2011 Mueller ..... B42C 7/005 412/25
2012/0155991 A1 * 6/2012 Friese ..... B42C 5/02 412/1
2013/0287524 A1 * 10/2013 Ganter ..... B42C 9/0025 412/5

* cited by examiner

METHOD FOR THE PREFORMING AND ROUNDING OF A BOOK BLOCK

CROSS-REFERENCE TO RELATED APPLICATION

Priority is claimed to Swiss Application No. CH 00133/16, filed Feb. 1, 2016, the entire disclosure of which is incorporated herein by reference in its entirety.

BACKGROUND OF THE INVENTION

The invention relates to a method for the preforming and rounding of book blocks for the industrial manufacturing of hardcover books. For the industrial manufacturing of such high-quality books, there is considerable pressure to come up with a method for an economically more reasonable automation of the process.

German patent document DE 102004026627 A1 proposes an apparatus for the preforming, rounding and pressing of book block backs in a single processing station. This development is designed to reduce the number of parts that needed to be replaced so far by assigning functions that previously were assigned to different machine components to a single preforming component. This preforming component should simultaneously function as a clamp during the preforming operation, as a template for the rounding operation and as a pressing tool.

European patent document EP 1350634 A2 also relates to an embodiment of a preforming component, wherein the replacement of such a component is to be avoided by using a form-changing preform.

Also known is a device for the preforming and rounding of a book block in a book-binding machine that includes a transport device and a support strip at an adjustable loading height for accommodating a fore-edge of the book block to be rounded. The apparatus furthermore includes a preform press arranged to be adjustable in a vertical direction above the book block back and two preform tools in the form of prism strips for processing the back of the book block. The prism strips are arranged spaced apart in a longitudinal direction above the book block back, such that they come in direct contact with the back of the book block. The apparatus is additionally provided with a rounding device, comprising two rolls driven in opposite directions, so that they can rotate around parallel axes of rotation.

A need exists for improvements in the processing method that make economic sense.

SUMMARY OF THE INVENTION

The invention provides that in dependence on the book block parameters, actuators of the processing station can cause an adjustment in the position of the components coming in contact with the book block back, of which there should be as few as possible.

According to an embodiment of the invention there is provide an apparatus for preforming and rounding of a book block in a book book-binding machine, the book block having a back, a fore-edge opposite the back and a block thickness, the apparatus comprising: a transport device; a support strip arranged at an adjustable loading height for accommodating the fore-edge of the book block to be rounded, wherein the transport device is adapted to transport the book block at the loading height toward the support strip; a preform press adapted to be adjustable in a vertical direction above the back of the book block and including at least two preforming tools for processing the back of the book block; a rounding device including two rounding rolls driven in opposite directions for rotation around parallel rotational axes and adapted to clamp the book block between the two rounding rolls for rounding the book block; and at least a first drive connected to at least one of the preforming tools to displace at least one of the preforming tools in a longitudinal direction extending parallel to the rotational axes to change a spacing between the preforming tools in the longitudinal direction.

According to another aspect of the invention there is provided a method for preforming and roll rounding a book block having a back, a fore-edge opposite the back and a block thickness, the method including, in one embodiment, the steps of: initially transporting with a transport device the book block at a loading height toward a support strip; moving preforming tools arranged spaced-apart in a longitudinal direction above the back of the book block toward each other or away from each other in a longitudinal direction with the use of a first drive for preparation of a preforming operation; placing the preforming tools with aid of a preform pressing device onto the back of the book block to preform the book blocks; and rounding sides of the book block with rounding rolls of a rounding device.

The apparatus can thus be adjusted more flexibly to the production process which at least favors automation. In addition, the number of operating parts can be reduced.

According to one embodiment of the apparatus, at least one second drive is connected at least indirectly to the support strip and/or the preform press and is operated by the machine control with adjustment of the block thickness, to adjust the loading height and/or the height position of the preforming tools in dependence on the book block thickness.

The loading height of known apparatuses was based on the rounding path since the folding edge must always be positioned at a certain height following the loading and rounding. According to an embodiment, the apparatus is adjusted for a format change at least additionally in dependence on the block thickness. This step makes economic sense because fewer replacement parts must be kept at hand and the parts must be replaced less often.

According to another embodiment of the apparatus, the preforming tools are embodied as prism strips, in particular as prism strips having edges that converge V-shaped, as seen in cross section.

Adapting the apparatus by using the prism strips as preforming tools that can be adjusted automatically makes possible a reduction in the number of such known replacement components. Even though the prior art required numerous prism strips to be made available for different book formats, their basic shape still contains several, so far unused degrees of freedom. If the components coming in contact with the book block can be changed automatically according to the invention, for example in dependence on the book block thickness, in this case by horizontally moving the prism strips in case of a possible change in the loading height, specific format changes do not automatically require the replacement of parts, at least not with a sensible work preparation and order grouping. The prism strips have slanted edges, for example, which can be used equally well for different book block thicknesses over a wide range, but would normally only permit specific book widths. The inventive apparatus can thus react with a change in height for the preform device. According to the invention, the loading height is computed with advantageous controls and is adjusted such that with a fixed rounding path, the backs of the differently thick book blocks are positioned along a horizontal line. According to other embodiments, the support strip is adjusted with the same control unit far enough for different book block thicknesses, so that the fore-edge rests on the circular surface of the support strip. The preform device with the prism strip is moved corresponding to the book block thickness far enough, so that the edges of the prism strip rests against the book back.

According to a different embodiment of the apparatus, the apparatus further comprises at least one carriage mounted on the preform press, wherein one or precisely two prism strips are arranged on the at least one carriage.

According to yet another embodiment of the apparatus, the apparatus further comprises at least one carriage mounted on the preform press, wherein the only preforming tools making contact with the book block back are precisely two prism strips, arranged on the at least one carriage each.

This type of arrangement permits the use of especially precise but less involved adjustment mechanisms.

Another embodiment of the apparatus provides for the prism strips to be replaced in dependence on the block thickness, wherein they respectively cover a thickness range of approximately 30 mm to 40 mm. In another embodiment, two replaceable sets of two prism strips are used, of which a small pair covers a thickness range of 5 mm to 40 mm and a large pair of prism strips covers the thickness range of 40 mm to 80 mm.

The preforming tools of a different apparatus according to the invention are operated in conjunction, so that they can be adjusted only symmetrical to a vertical center axis of the book block.

According to another embodiment of the apparatus, the preforming tools can be adjusted with a single adjustment spindle, preferably with right/left thread, either symmetrically toward each other or away from each other.

According to one embodiment of the method, the loading height and/or the preform press is adjusted in dependence of at least the block thickness, in particular by approximately 0.2 mm per 1 mm block thickness, especially preferred also in dependence of selectable rounding radii. According to another advantageous embodiment, the adaptation of the apparatus depends on the geometric form of the edges of the existing prism strips and/or prism strips which can be inserted.

According to another embodiment of the method, the loading height is adjusted exclusively by adjusting the support strip in dependence on the rounding path, the book block thickness, the distance of the folding edge from the back of the book block and a movement path of the outer edges of the prism strips embodied as preforming tools.

According to a different embodiment of the method, the preforming tools are adjusted in dependence of at least one book block parameter by a preset distance X in vertical direction Y.

Another embodiment of the method provides for the preforming tools to be adjusted, relative to each other, in dependence of at least one book block parameter by a preset distance in a horizontal direction, namely symmetrical with respect to a center axis of the book block.

BRIEF DESCRIPTION OF THE DRAWINGS

The invention is described further in the following with the aid of an exemplary embodiment.

DETAILED DESCRIPTION

Figure 1:
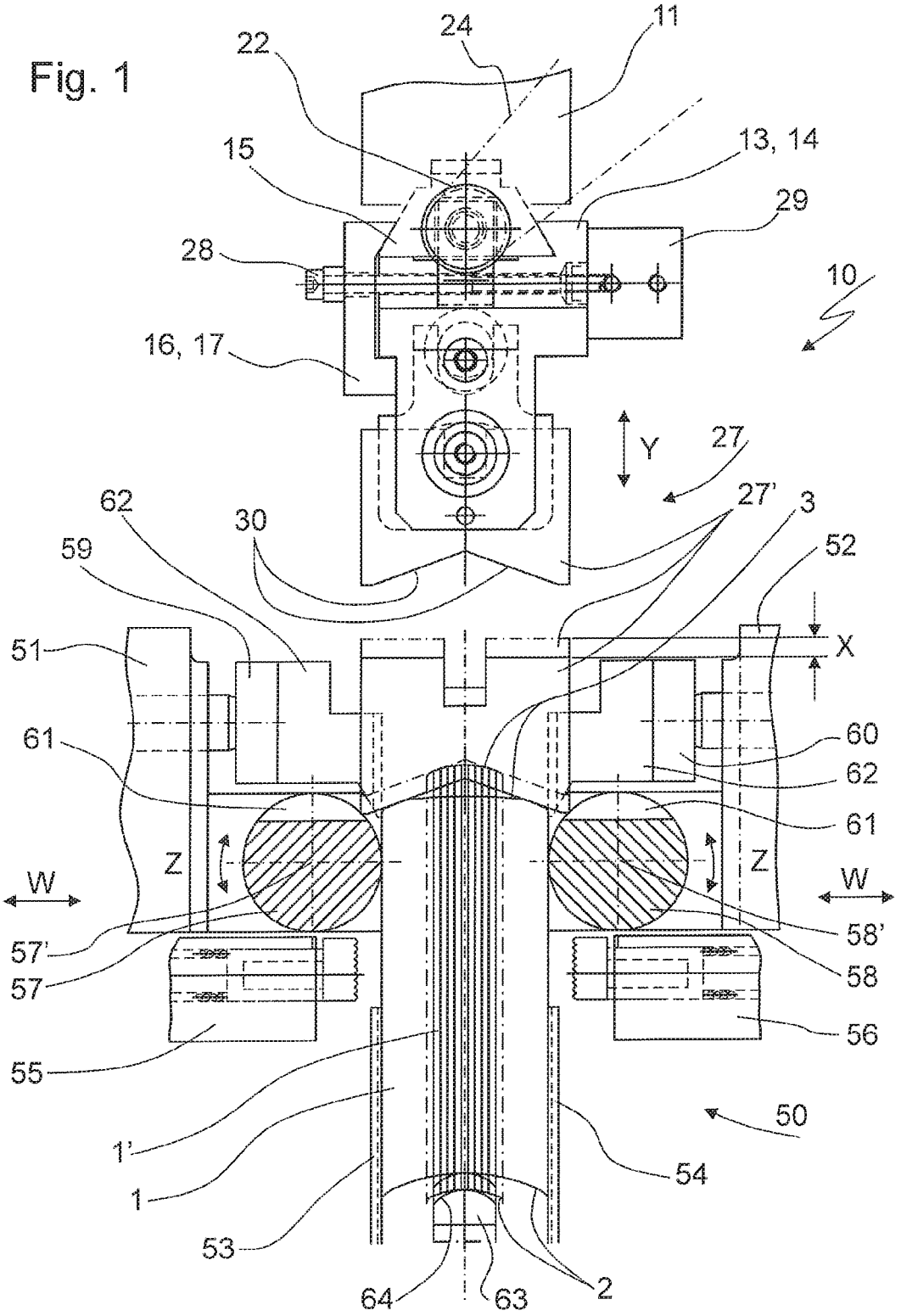
FIG. 1 shows details of a cross-sectional view through a processing station of a book-binding machine, namely through an inventive apparatus with two book blocks, having different thicknesses and placed one above the other, which are shown with a solid line and a dash-dot line, respectively.

FIG. 1 shows an apparatus 10 according to an embodiment of the invention for the preforming and rounding of a book block 1, 1' of two different thicknesses, wherein one is shown with a solid line and the other with a dash-dot line. The preforming takes place with preforming tools 27, embodied as prism strips 27' and arranged above the back 3 of a book block 1, 1', so that they can act at a later time upon the back 3 (see FIG. 2). The prism strips 27' of the embodiments according to the invention can cover a rather large thickness range for the book blocks 1, 1' because of the prism edges 30 and their special position. To illustrate this function of the inventive apparatuses 10, two book blocks 1, 1' having very different block thicknesses are shown, wherein the first book block 1 has a greater block thickness and the second book block 1', which is shown with a dash-dot line, has a smaller block thickness as compared to the first book block 1.

Above the book block 1, 1', the apparatus 10 comprises two carriages 13, 14 with replaceable prism strips 27'. At a distance thereto and essentially adjacent to the book block 1, 1', a rounding device 50 is shown with rounding rolls 57, 58, between which the book block 1, 1' can be clamped in. The prism strip 27' in FIG. 1 is shown simultaneously in an upper and a lower position. In the lower position, the prism edges 30 come in contact with the back 3 of the thicker book block 1. The dash-dot line shows how the prism strip 27' with its prism edges 30 comes in contact with the back 3 of the smaller thickness book block 1'. The difference between these two representations shows the format-dependent adjustment path of the apparatus 10 for one advantageous method according to the invention, meaning a predetermined distance X by which the respective preforming tools 27 are adjusted in the vertical direction Y, in dependence on at least one parameter of the book block 1, 1'.

During the preforming operation, the prism edges 30 press with a defined force onto the back 3 of the book block 1, 1' and thus press a fore-edge 2 that slides onto a support strip 63 of the book block 1 and 1' with a defined force against a circular surface 64 of the support strip 63. For book blocks 1, 1' with a straight back, the preforming operation only serves to align the book blocks 1, 1', and support strips 63 are used which have a plain surface in place of the circular surface 64 and only a straight edge 30 for the prism strip 27'.

The guide rakes 59, 60, the rounding rolls 57, 58, and the side plates 53, 54 in this case are adjusted narrow enough, so that the book block 1, 1' does not slide out due to the pressure exerted by the prism strips 27' but can still be displaced in the vertical direction Y.

According to one embodiment of the invention, a planned height adjustment of a preform press 11 to adjust to a new book block 1, 1' format occurs through the prior adjustment of a loading height for the apparatus 10, namely a position of the prism strip 27' in the direction of the back 3 of the respective book block 1, 1', and/or based on a specific adjustment of a support strip 63 in the vertical direction Y.

Figure 2:
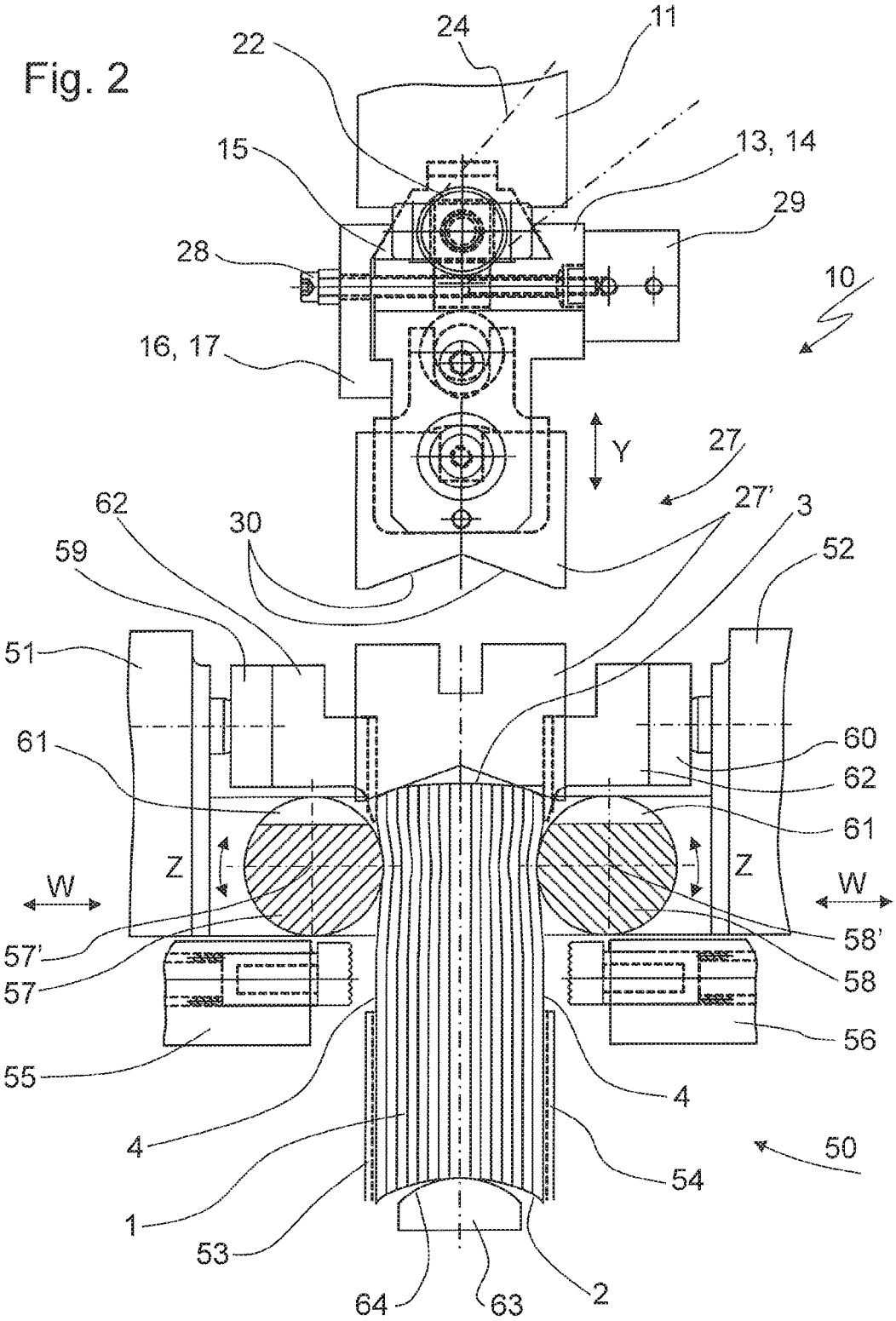
FIG. 2 illustrates the apparatus according to FIG. 1, showing the thicker of the two book blocks indicated in FIG. 1 which is clamped in between two rounding rolls.

FIG. 2 shows the prism strips 27' resting against the back 3 in a lower end position of the preform press 11 for the apparatus 10. The two rounding rolls 57, 58 in that case are shown in a closed position where the book block 1 is fixated. As compared to FIG. 1, the rounding carriages 51, 52, which accommodate the rounding rolls 57, 58, are moved together with the guide rakes 59, 60 and the rounding rolls 57, 58 by a defined distance in the horizontal direction W toward each other, transverse to the book block 1. The two guide rakes 59, 60 are spring-loaded and fit with a slight pressure against the header 4 of the book block 1. Depending on the movement profile of the preform press 11 and/or the support strip 63, and depending on the individual movement profiles of the rounding rolls 57, 58, the book block 1 and the prism strips 27' move upward. The two rounding rolls 57, 58 in that case rotate in opposite directions around their parallel axes of rotation 57', 58', in rotational direction Z toward the outside. As soon as the pre-rounding process is completed, the book block 1 is clamped in by the transport devices 55, 56, and the rounding carriages 51, 52 with the guide rakes 59, 60 and the rounding rolls 57, 58 move by a defined distance in the horizontal direction W toward the outside and release the book block 1.

The transport devices 55, 56 subsequently move the clamped-in book block 1 in the horizontal, longitudinal direction V (FIG. 4) out of the rounding device 50. The rounding rolls 57, 58 then rotate back far enough so that the recesses 61 in the rounding rolls 57, 58 are positioned horizontally. The movement profile of the the apparatus 10 components in the Y direction and the movement profile in the Z direction of the rounding rolls 57, 58 are specified anew for each format in dependence on the thickness of the book block and the rounding to be achieved.

Figure 3:
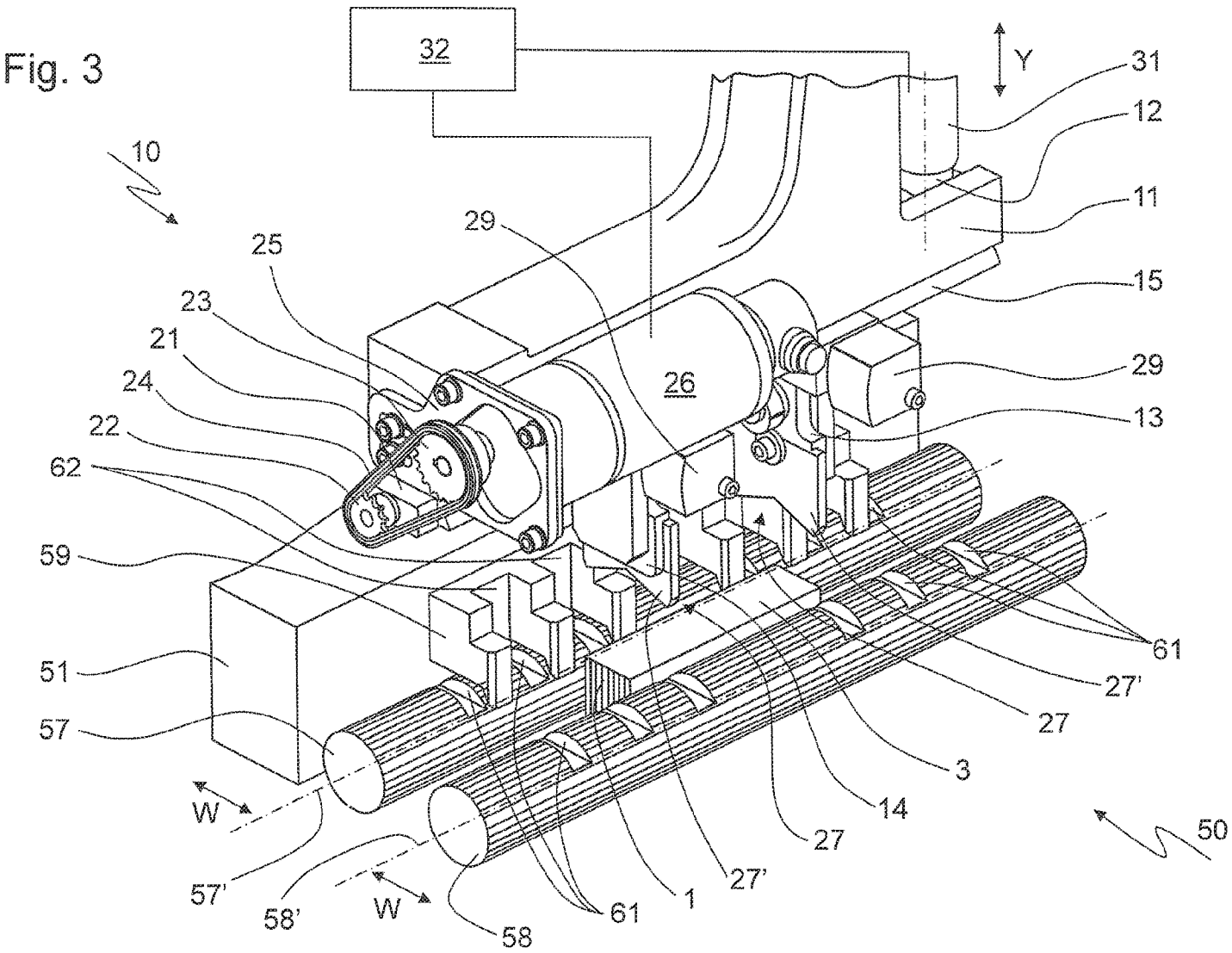
FIG. 3 shows a perspective, angled view from above onto selective components of the apparatus shown in FIG. 1, wherein a book block with relatively small block height is processed for which the preforming tools are adjusted at a smaller distance from each other.

FIG. 3 shows the apparatus 10 with parts of the rounding device 50 and a book block 1, in this case having a small block height as seen in the longitudinal horizontal direction V (FIG. 4) that extends parallel to the axes of rotation 57', 58' of the rounding rolls 57, 58. The book block 1 is clamped in between the rounding rolls 57, 58 and the guide rakes 59, 60, wherein the guide rake 60 is blanked out to better see the additionally described components. The position of the carriages 13, 14 is adjusted such that these can enter with the built-in prism strip 27' into the recesses 62 of the guide rakes 59, 60, positioned closest to each other and symmetrical toward the center, as well as into the recesses 61 of the rounding rolls 57, 58, also positioned closest to each other and symmetrical toward the center. Also shown is a guide rod 12, along which the preform press 11 is adjusted in the vertical direction Y with a drive 31 of a cam gear, as well as a control unit 32 which actuates the drive 31.

In addition, drive 31 can be connected at least indirectly to the support strip 63 shown in FIG. 1 and/or the preform press 11 and can be operated by a machine control, also not shown herein, to match the block thickness by adjusting the loading height and/or the height position of the preforming tools 27 in dependence on the block thickness.

Figure 4:
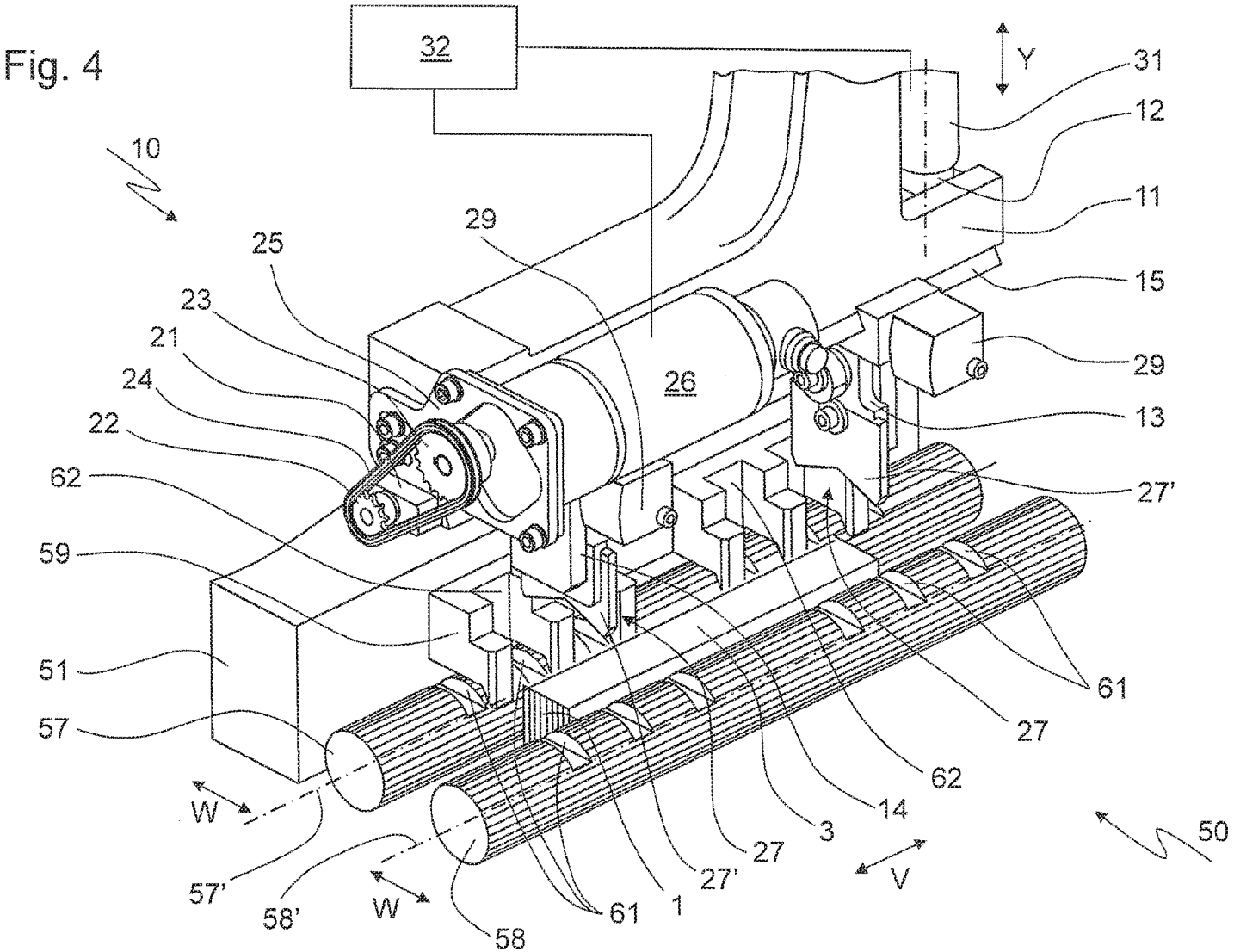
FIG. 4 shows a further view according to FIG. 3, wherein a book block with greater block height is processed, causing the preforming tools to be adjusted to be spaced further apart.

FIG. 4 corresponds to FIG. 3 with the difference that the book block 1 is shown with a larger block height extending in longitudinal direction V. The two carriages 13, 14 are shown at a greater distance to each other, as compared to FIG. 3, which corresponds to the greater block height. The carriages 13, 14 can enter the sequentially following recesses 62 in the guide rakes 59, 60; and the recesses 61 of the rounding rolls 57, 58, sequentially following toward the outside. The recesses 62 in the guide rakes 59, 60 and the recesses 61 in the rounding rolls 57, 58 are distributed symmetrical to the center of the rounding device 50 for the preferred embodiment shown herein.

Figure 5:
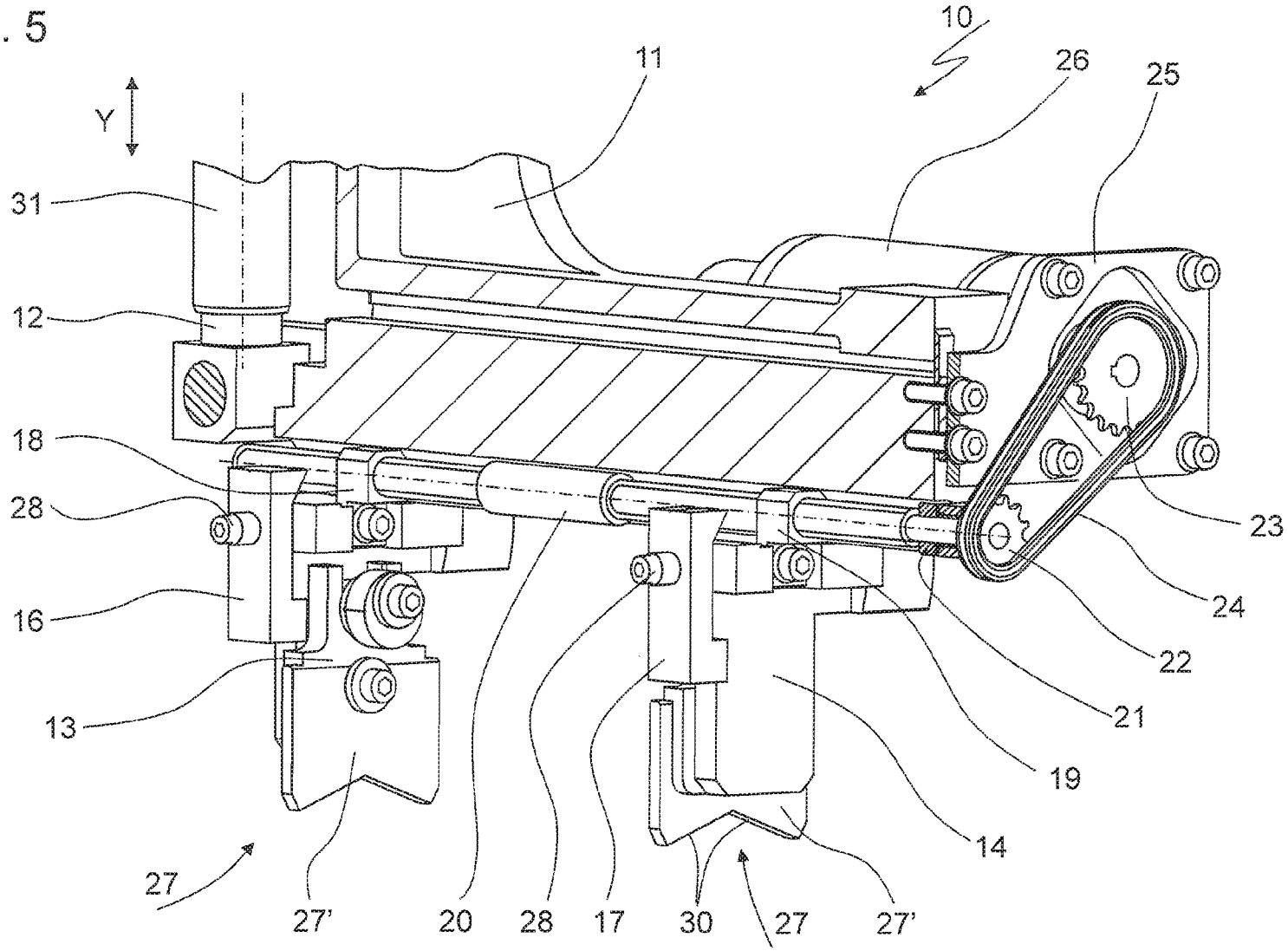
FIG. 5 shows a perspective view of a section through the apparatus according to FIG. 1, showing a reduced selection of these components, meaning only those important for the adjustment of the preforming tools according to an embodiment of the invention.

The apparatus 10 in FIG. 5 is shown only partially, showing only a complete view of its adjustment schematic, with the two carriages 13, 14 and the replaceable prism strips 27' which can be displaced along a guide strip 15 (FIG. 1). The carriages 13, 14 are provided with adjustment nuts 18, 19 which can be adjusted via a spindle 20. Ideally, the adjustment spindle 20 is provided with a left and right thread, so that the carriages 13, 14 can be adjusted symmetrically toward the center of the apparatus 10 and thus also toward the center of the book block 1. The adjustment spindle 20 is positioned inside a bearing block 21 and is driven with the aid of a first drive 26, attached to a motor plate 25 and embodied as adjustment motor, which is also connected to the control 32 (FIG. 3). The drive 26 is shown, for example, with a chain wheel 22 resting on the adjustment spindle 20 and a chain wheel 23 sitting on the adjustment motor, wherein these chain wheels 22, 23 are connected via a chain 24. With the aid of the first drive 26, the prism strips 27' can be displaced in a longitudinal direction extending parallel to the rotational axes 57', 58' of the rounding rolls 57, 58, so that the distance between the prism strips 27' can be changed in the longitudinal direction.

Since the prism strips 27' must enter the recesses 62 of the guide rakes 69, 60, shown in FIG. 1, they can only be adjusted within a specified grid. The carriages 13, 14 are secured with clamping mechanisms against sliding during the production. The clamping mechanisms are released prior to the adjustment and are subsequently closed again, wherein, preferably, pneumatic clamping mechanisms are used. Shown herein is a clamping mechanism for which a clamping cylinder 29 (FIG. 1) moves a clamping bolt 28 which then secures the carriages 13, 14 via the clamping strips 16, 17 on the guide strip 15 (FIG. 1).

Below the upper format limit and above the lower format limit for the replaced prism strip 27', the format-related adjustments are automatic. A change to a different pair of prism strips 27' to cover a deviating thickness range for the book block 1 takes place if the currently used prism strips 27' are either too wide or too narrow for the newly loaded book block 1. The second pair of prism strips 27' are replaced manually and the replacement is indicated automatically by the machine. For this, the following order is measured or is input as a dataset during the current production. The machine operator is informed via display of the upcoming replacement, so that the replacement parts can be made available in order to also reduce the replacement times to a minimum. Since only two replacement parts are used, the presence of a specific replacement part can be queried easily via sensors, and the use of the correct replacement part can always be monitored. With the aid of such a production control, the orders can be combined corresponding to the format change and the effectiveness can thus be increased.

It will be understood that the above description of the present invention is susceptible to various modifications, changes and adaptations, and that the same are intended to be comprehended within the meaning and range of equivalents of the appended claims.

What is claimed is:

1. An apparatus for preforming and rounding of a book block in a book book-binding machine, the book block having a back, a fore-edge opposite the back and a block thickness, the apparatus comprising:

a transport device;

a support strip arranged at an adjustable loading height for accommodating the fore-edge of the book block to be rounded, wherein the transport device is adapted to transport the book block at the loading height toward the support strip;

a preform press adapted to be adjustable in a vertical direction above the back of the book block and including at least one carriage mounted on the preform press and at least two preforming tools comprising prism strips, built-in to the at least one carriage for processing the back of the book block;

a rounding device including two rounding carriages, each accommodating a guide rake with a number of first recesses and a rounding roll with a number of second recesses, the first and the second recesses are spaced apart each in a longitudinal direction extending parallel to rotational axes of the rounding rolls, the rounding rolls driven in opposite directions for rotation around the parallel rotational axes and adapted to clamp the book block between the two rounding rolls for rounding the book block; and at least a first drive connected to at least one of the preforming tools to displace the at least one of the preforming tools together with its carriage in the longitudinal direction extending parallel to the rotational axes of the rounding rolls to change a spacing between the preforming tools in the longitudinal direction and to place the at least one preforming tool together with its carriage such that the at least one preforming tool with the built-in prism strip enters into a selected one of the first recesses of the guide rakes and into a selected one of the second recesses of the rounding rolls in dependence of a block height in the longitudinal direction.

2. The apparatus according to claim 1, further comprising at least one second drive connected at least indirectly to at least one of the support strip and the preform press and operable by a machine control to match the block thickness to adjust at least one of the loading height and a height position of the preforming tools in dependence on the block thickness.

3. The apparatus according to claim 1, wherein the prism strips having edges that converge in a V shape as seen in a cross-sectional view.

4. The apparatus according to claim 3, wherein one or precisely two prism strips are arranged on the at least one carriage.

5. The apparatus according to claim 3, wherein precisely two prism strips are arranged on the at least one carriage and constitute the only preforming tools which contact the back of the book.

6. The apparatus according to claim 3, wherein the prism strips are replaceable in dependence on the block thickness and are respectively adapted to cover a block thickness range of approximately 30 mm to 40 mm.

7. The apparatus according to claim 3, wherein the prism strips comprise two pairs of replaceable prism strips including a first pair of prism strips adapted to cover a block thickness range of 5 mm to 40 mm and a second pair of prism strips adapted to cover a block thickness range of 40 mm to 80 mm.

8. The apparatus according to claim 3, wherein the prism strips are replaceable in dependence on the block thickness and collectively adapted to cover a block thickness range of approximately 5 mm to 80 mm.

9. The apparatus according to claim 1, wherein the at least two preforming tools are coupled together so that they can be adjusted exclusively symmetrical to a vertical center axis of the book block.

10. The apparatus according to claim 1, further comprising a single adjustment spindle adapted to adjust a position of the preforming tools symmetrically toward each other or away from each other.

11. A method for preforming and roll rounding a book block comprising utilizing the apparatus according to claim 1.

12. A method for preforming and roll rounding a book block having a back, a fore-edge opposite the back and a block thickness, the method comprising:

initially transporting with a transport device, the book block with its fore-edge toward a support strip at a loading height;

moving preforming tools arranged spaced-apart in a longitudinal direction above the back of the book block toward each other or away from each other in a longitudinal direction with the use of a first drive for preparation of a preforming operation, wherein the preforming tools include prism strips;

placing the preforming tools with aid of a preform pressing device including the preforming tools and at least one carriage mounted on the preform pressing device onto the back of the book block to preform the book blocks;

rounding the book block with rounding rolls of a rounding device acting on sides of the book block, the rounding device including two rounding carriages, each accommodating a guide rake with a number of first recesses and a rounding roll with a number of second recesses, the first and the second recesses being spaced apart each in a longitudinal direction extending parallel to the rotational axes of the rounding rolls; and placing the at least one preforming tool together with its carriage such that the at least one preforming tool with the built-in prism strip enters into a selected one of the first recesses of the guide rakes and into a selected one of the second recesses of the rounding rolls in dependence of a block height in the longitudinal direction.

13. The method according to claim 12, further comprising adjusting at least one of the loading height and a vertical position of the preform press in dependence on at least the block thickness.

14. The method according to claim 13, wherein the adjusting includes adjusting in dependence of approximately 0.2 mm per 1 mm block thickness.

15. The method of claim 13, wherein the adjusting includes adjusting in dependence on at least one of selectable rounding radii and a shape of the prism strip edges of at least two of the preforming tools.

16. The method according to claim 12, wherein the prism strips have outer edges, and further including adjusting the loading height exclusively by adjusting the support strip in dependence on at least one of a rounding path, the block thickness, a distance between a folding edge and the back of the book block, and a traversing path of the outer edges of the prism strips.

17. The method according claim 12, further including displacing the preforming tools in dependence on at least one parameter of the book block by a specified distance X in a vertical direction Y.

18. The method according to claim 12, further including adjusting the preforming tools relative to each other in a horizontal direction by a predetermined distance in dependence on at least one parameter of the book block and symmetrical with respect to a center axis of the book block.

* * * * *